US006266933B1

(12) United States Patent
Park

(10) Patent No.: US 6,266,933 B1
(45) Date of Patent: Jul. 31, 2001

(54) TWO PART DOOR FRAME COVER

(76) Inventor: Dong Sub Park, 604-2402 Joonghung APT 1054 Joong 3 dong, Wonmi-gu, Puchon, Kyunggi-do (KR)

( * ) Notice: Subject to any disclaimer, the term of this patent is extended or adjusted under 35 U.S.C. 154(b) by 0 days.

(21) Appl. No.: 09/448,592

(22) Filed: Nov. 24, 1999

(30) Foreign Application Priority Data

Feb. 11, 1999 (KR) ..... 99-2236

(51) Int. Cl.[7] ..... E06B 3/30

(52) U.S. Cl. ..... 52/210; 52/212; 52/312; 52/313; 52/300

(58) Field of Search ..... 52/210, 211, 212, 52/312, 300, 393, 395, 746.01; 49/411, 462

(56) References Cited

U.S. PATENT DOCUMENTS

| | | | |
|---|---|---|---|
| 2,292,024 | 8/1942 | Dreher | 52/746.1 X |
| 3,364,624 | 1/1968 | Davis | 49/505 |
| 3,609,928 | 10/1971 | Mock | 49/505 |
| 3,654,734 | 4/1972 | Lehman | 49/505 |
| 3,676,966 | 7/1972 | Ragland | 52/211 |
| 3,788,019 | 1/1974 | Kiselewski | 52/212 |
| 3,812,621 | 5/1974 | Ragland | 49/505 |
| 5,214,880 | 6/1993 | Woodruff et al. | 49/490 |
| 5,412,909 | 5/1995 | Wu | 49/505 |

*Primary Examiner*—Carl D. Friedman
*Assistant Examiner*—Phi Dieu Tran A
(74) *Attorney, Agent, or Firm*—Robert Halper

(57) ABSTRACT

A two part injection molded plastic cover designed to cover a wooden door frame mounted to a surrounding wall. The cover parts are prefabricated and adhesively secured to one another. The cover parts overlap one another and the overlapping cover has a groove filled with packing to act as a seal between an adjacent door and the cover. The cover serves to mask any damages that might have occurred to the door frame and also is aesthetically attractive, especially since it can be stained to resemble natural wood, or painted with any one of a number of colors. A section of the cover that faces frontally is overlaid with an ornamental molding.

8 Claims, 2 Drawing Sheets

TWO PART DOOR FRAME COVER

FIELD OF INVENTION

This invention pertains to a two part door frame cover wrapped around a wooden door frame.

BACKGROUND OF THE INVENTION

Generally construction of a building such as a house is done after a door frame is temporarily fixed with pins to the wall of the building. Therefore the frame is often damaged when the workers transport building materials through the opening adjacent the door frame; furthermore even after the frame is permanently set in place with mortar, removal of the aforesaid pins leaves unsightly holes that often require sanding down of the surface as well as painting the door frame.

The prior art illustrates a number of door frame covers as well as door frames of various designs.

U.S. Pat. No. Des. 408,089 shows a one piece ornamental design door for a cover attached between the door and a frame.

U.S. Pat. No. 3,584,771 illustrates a rear frame with an inner post and an outer post.

U.S. Pat. No. 3,690,037 depicts a prefabricated door and frame assembly wherein the door is made of metal and the frame of wood. Weather stripping is also placed in the rails of the door frame.

U.S. Pat. No. 3,812,621 is an example of an adjustable door frame assembly wherein support means for the door is enclosed by a overlapping L-shaped members which are telescopically adjustable to accommodate walls of varying thickness.

U.S. Pat. No. 4,126,975 shows a two piece door jamb wherein the two pieces are secured by a screw. The jambs have clamping portions for securing to the door frame. The object of the invention is to provide a novel pre-fabricated assembly for wall openings so constructed and arranged that the component members thereof disposed in true vertical or horizontal position regardless of the possible departure from level or plumb lines of the edge facings of the openings.

U.S. Pat. No. 4,768,320 shows a door frame guard for protecting a door jamb and door trim.

U.S. Pat. No. 5,214,880 teaches a door edge construction having a rectangular door having an elongated H shaped extrusion attached to and extending along one edge of the door. To hide the screws in the extrusion member a C-shaped side cap is fitted over the side member.

U.S. Pat. No. 5,775,045 is another example of a door frame guard designed to protect the paint on the corners and edges of a metal door frame. The door frame guard is removable and has a plurality of interfaces which interact with the surfaces of the door frame and a linking member which extends between the plurality of interface members and spans the contour of the door frame from front to back.

U.S. Pat. No. 5,799,443 illustrates a temporarily installed resilient, shock-absorbent cover to protect the vulnerable parts of door and door frames as well as the archway frames and the furniture that passes through the doors. The cover includes a hinge side frame cover temporarily attached to the door.

U.S. Pat. No. 5,836,118 shows a door jamb system integrally connected to a door frame. The jamb system has a cladding of plastic which is attached to the door jamb substrate through compression deflected fingers.

While the art of record is not without merit in illustrating protective covers that improve structural integrity as well as the aesthetic appearance, they are either one piece members or are not as economical or versatile as could be achieved.

Therefore it is an object of this invention to provide a two piece cover which is simple in construction and easy to apply to a door frame and is also readily replaceable.

It is a further object of this invention to produce a two part cover made from an injection molded plastic which can be readily secured to a wooden door frame.

It is still an object of this invention to produce a door frame cover that blends with the natural color of the door frame, or alternatively the cover can be painted with a variety of colors.

It is also an object of this invention to produce a pre-fabricated door frame cover that is adjustable in accordance with the thickness of the wall and the door frame.

SUMMARY OF THE INVENTION

The cover for the door frame is comprised of two parts, a first cover and a second cover wherein the second cover overlaps the first cover. The covers are made of injection molded plastic and are adhesively attached to each other. The covers are stained to resemble a natural wood or alternatively can be painted a variety of colors to suit, and the amount of overlap of the second cover with the first cover can be adjusted in accordance with the width of the door frame and the thickness of the wall. Both covers are wrapped around the door frame, and the second cover is configured with a groove between the steps that is filled with packing. The packing is located adjacent the door and acts as a seal. The cover that fits around the trim of the frame is affixed with an ornamental molding to mask the pins used to secure the cover around the trim.

DETAILED DESCRIPTION OF THE INVENTION

Figures 1, 2, 3:
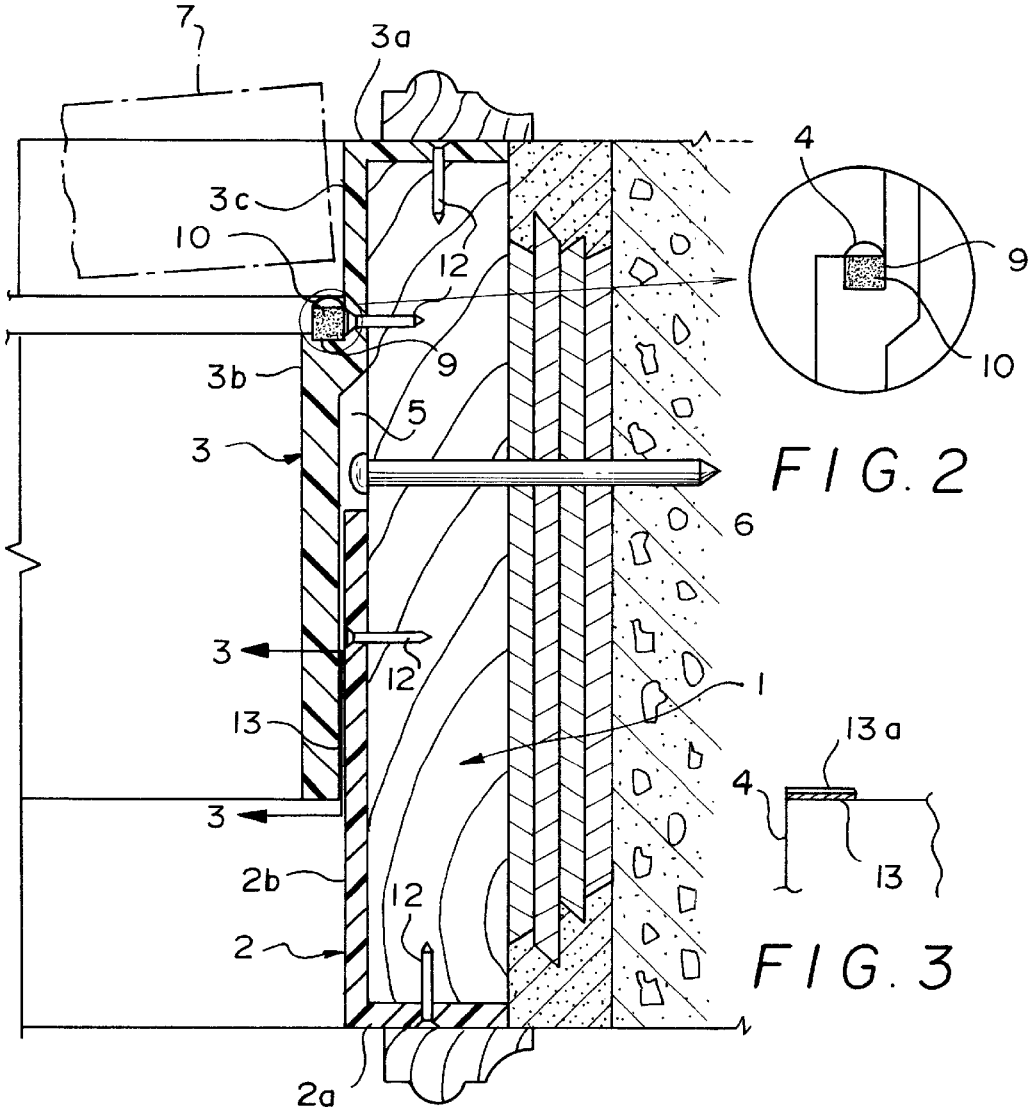
FIG. 1 is a plan view of the assembly of the door frame and the cover and includes a door section and surrounding wall structure.
FIG. 2 is an enlarged partial view of FIG. 1 showing the groove and packing in the second cover.
FIG. 3 is a section taken on line 3—3 of FIG. 1 showing the adhesive and peelable strip.
Figure 4:
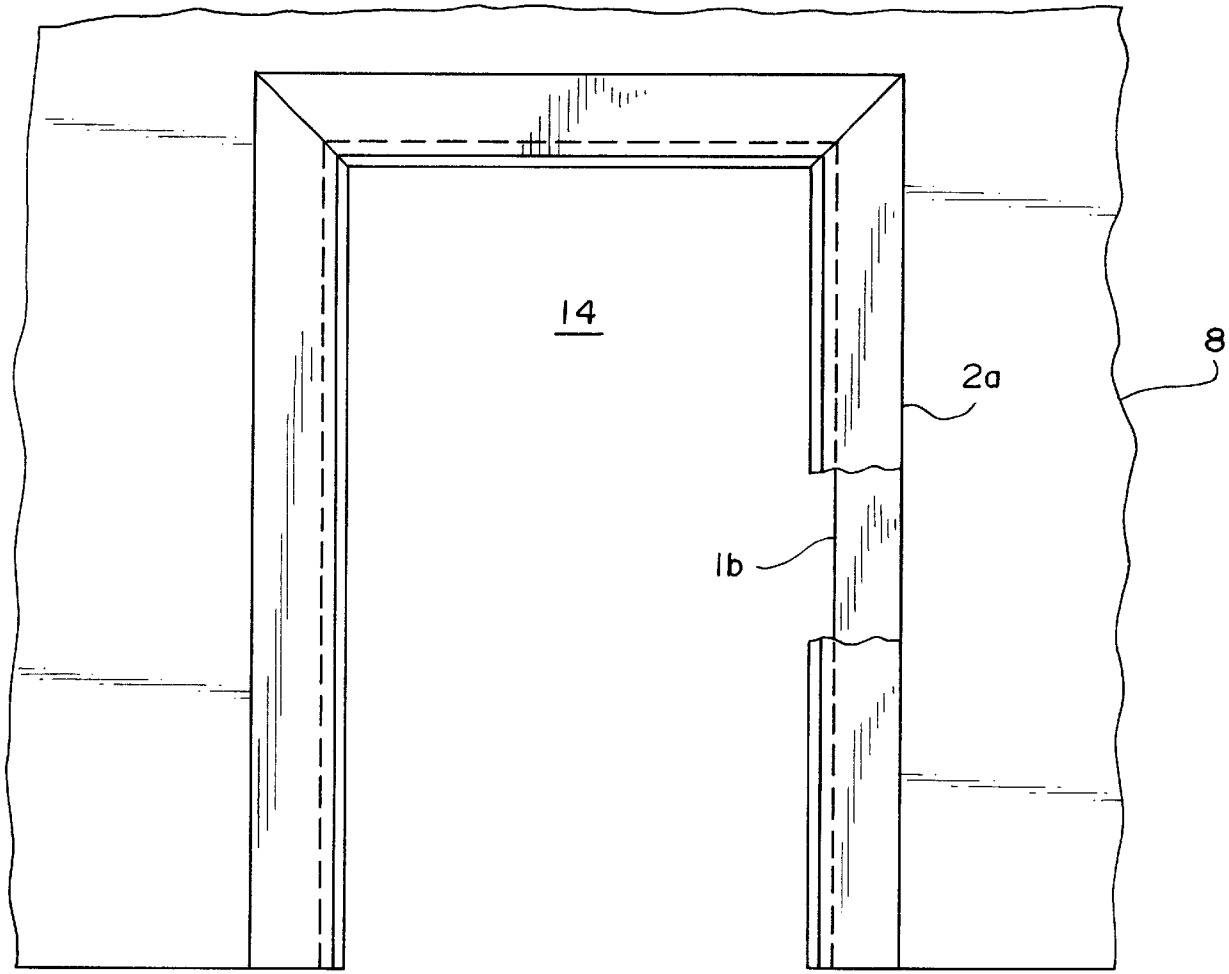
FIG. 4 is a front elevation showing a door opening, a door frame cover enveloping the door frame and the surrounding wall.

FIG. 1 shows an assembly including a wooden door frame, door frame cover and a partial view of the door and surrounding structure. The wooden door frame 1 member comprises door jambs 1*a,* trim 1*b* and an overhead 1*c* over the doorway 14. The trim 1*a* is the width part of the frame covered by the short leg of the covers 2 and 3—shown in FIG. 1. This frame, except for a small area around the hinges, is completely covered by a two part cover that comprises first cover 2 and a second cover 3 which overlaps the first cover. The cover members are made of injection molded plastic that is generally stained to resemble a natural wood, or the cover can be painted various colors to suit. The first cover is an angle having its short leg 2*a* wrapped around the trim of the frame and its long leg 2*b* extending over a section of the jambs of the frame. The angle is secured to the frame with pins or studs 12 which are spaced along the length of the frame and cover. The second cover is also in the form of an angle with its short leg 3*a* wrapped around the trim. The long leg is stepped with the upper step 3*b* partially overlapping the leg 2*b* and the lower step 3*c* extending the remainder of the width of the jamb. The second cover is secured to the frame in the fashion as aforementioned. The overlapping section of the respective covers are fastened together by a plastic adhesive 13. The adhesive is applied to the underside of the upper step of the second cover and extends from an edge thereof for an inch or two. The adhesive is covered by a peelable strip 13*a* that is removed just prior to assembly to the frame. Between the steps of the second cover, there is a groove 9. This groove is filled with a rubber packing 10. Extending over the packing is a flexible arcuate shield 4. As seen in FIG. 1 this packing is placed adjacent hinged door 7 and acts as a seal between the door and cover that helps to muffle extraneous sounds. The covers are prefabricated so at the time of assembly, all that is necessary is to join the covers together and fix them to the frame. Between the overlap of the first and second covers and the region of the step, there is a small gap 5. Before the covers are placed around the frame, nails 6 are placed along the length of the frame that are used to fix the frame to the surrounding wall structure 8.

The steps involved in application of the covers involve securing the first cover to the frame with pins or studs and ascertaining that the pins or studs do not protrude beyond the surface of the respective covers. The second cover is placed over the first cover to partially overlap the same with adjustments made as to placing the second cover in accordance with the width of the door jamb and aligning the second cover so that the packing is adjacent the door. Peeling away the wrapper from the adhesive on the second cover and adhesively joining the two covers is the next step. To mask the nails that pass through the trim and cover an ornamental molding 15 is adhesively joined to the cover. The end result is a smooth finish around the door frame having the appearance of a natural wood, or alternatively painted with any one of a number of conventional colors. In the event that the cover becomes shabby, discolored or damaged, or if it is desired to change the color, it is readily replaceable since the covers are prefabricated and it takes but a few minutes to remove the pins connecting the covers to the frame.

While an embodiment of the invention has been shown and described in detail, it should be understood that various modifications and changes could be made that would be obvious to one skilled in the art, and that could be considered within the scope of the invention as defined by the appended claims.

I claim:

1. A cover for a wooden door frame that includes door jambs, trim and overhead, surrounds the opening for a door and is mounted to a surrounding wall, comprising:

a) A two part injection molded plastic cover including a first cover and a second cover, said second cover overlapping said first cover with a gap between said overlapping covers, b) said second cover being adhesively secured to said first cover being in the form of an angle having a short leg adapted to wrap around one trim of said wooden frame and a long leg for partially covering said jamb of said frame, said first cover being adapted to affix to said frame by a plurality of spaced pins that pass therethrough, c) said second cover being in the form of a stepped angle having an upper step and a shorter lower step, said lower step serving to extend around a remainder of said frame and having a short unflanged leg adapted to wrap around another of said trim to be affixed by pins thereto, a groove located between said steps, a packing inserted snugly on said groove and a flexible plastic shield placed over said packing.

2. A cover as in claim 1 wherein said first and second covers are prefabricated, said covers adapted to be adjustable in accordance with the width of the door frame, said frame being generally U-shaped arranged for alignment adjacent said door, said packing acting as a seal between said cover and said door.

3. A cover as in claim 1 wherein said cover is stained to resemble a natural wood.

4. A cover as in claim 1 wherein said cover is painted with any one of a number of colors.

5. A cover as in claim 1 wherein said adhesive is applied to an underside of said upper step of said cover, said adhesive extending inwardly from an edge of said overlap of said upper step for about one to two inches, said adhesive having a peelable strip thereover which is removed at the time of joining said first and second covers.

6. A cover as in claim 1 wherein a plurality of spaced nails are placed in said gap adapted to secure said frame to said wall prior to assembly of said first and second covers and said pins adapted for fixing to said frame do not protrude above said first and second covers.

7. A cover as in claim 6 wherein said pins that secure said short legs of said cover to said trim are overlaid with an ornamental molding.

8. A cover as in claim 1 wherein said first and second covers are readily replaceable.

* * * * *